US010047741B2

(12) United States Patent
Zhang et al.

(10) Patent No.: US 10,047,741 B2
(45) Date of Patent: Aug. 14, 2018

(54) MONITORING SYSTEM FOR FLUID PUMP

(71) Applicant: Caterpillar Inc., Peoria, IL (US)

(72) Inventors: Yanchai Zhang, Dunlap, IL (US); Daryl Belshan, Tremont, IL (US); Vijay Janardhan, Dunlap, IL (US); Zhaoxu Dong, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 188 days.

(21) Appl. No.: 15/240,581

(22) Filed: Aug. 18, 2016

(65) Prior Publication Data

US 2016/0356270 A1 Dec. 8, 2016

(51) Int. Cl.
*F04B 51/00* (2006.01)
*F04B 49/06* (2006.01)

(52) U.S. Cl.
CPC ..... *F04B 51/00* (2013.01); *F04B 49/065* (2013.01); *F04B 2201/0802* (2013.01); *F04B 2205/02* (2013.01); *F04B 2205/04* (2013.01)

(58) Field of Classification Search
None
See application file for complete search history.

(56) References Cited

U.S. PATENT DOCUMENTS 5,499,538 A 3/1996 John et al.
7,013,223 B1 * 3/2006 Zhang ..... F02M 65/003 417/53
8,554,494 B2 10/2013 Sarmad et al.
8,979,505 B2 3/2015 Jean et al.
9,206,667 B2 * 12/2015 Khvoshchev ..... E21B 34/16
2007/0140869 A1 * 6/2007 St. Michel ..... E21B 47/0008 417/53
2008/0006088 A1 * 1/2008 Wago ..... F04B 51/00 73/587
2014/0290768 A1 10/2014 Coy et al.
2015/0356521 A1 12/2015 Garud et al.

FOREIGN PATENT DOCUMENTS

CN 104612957 5/2015
WO WO2016019219 2/2016

* cited by examiner

*Primary Examiner* — Andre Allen

(57) ABSTRACT

A monitoring system for a fluid pump having a fluid end and a power end is provided. The monitoring system includes an inlet pressure sensor attached to an inlet manifold of the fluid end. The inlet pressure sensor generates a signal indicative of an inlet pressure of a fluid being supplied to the fluid end. The monitoring system includes a discharge pressure sensor attached to the fluid end. The discharge pressure sensor generates a signal indicative of a discharge pressure of the fluid exiting the fluid end. The monitoring system includes at least one accelerometer attached to the fluid end. The accelerometer generates a signal indicative of vibrational data of the fluid pump. The monitoring system includes a controller which receives signals from the inlet pressure sensor, the discharge pressure sensor and the accelerometer and determines a possible failure mode of the fluid pump.

8 Claims, 3 Drawing Sheets

MONITORING SYSTEM FOR FLUID PUMP

TECHNICAL FIELD

The present disclosure relates to a fluid pump used in oil and gas well development. More specifically, the present disclosure relates to prognostic means for identification of an impending failure in the fluid pump.

BACKGROUND

In certain situations, workers in the oil and gas industry perform a procedure known as "hydraulic fracturing" during a well development. For example, in formations where oil or gas cannot be easily or economically extracted from the earth, a hydraulic fracturing operation is commonly performed. Such a hydraulic fracturing operation includes pumping in large amounts of fluid to induce cracks in the earth, thereby creating pathways via which the oil and gas may flow. Hydraulic fracturing pumps or "frac pumps" as they are known in the industry, are relatively massive positive displacement pumps capable of countering enormous pressure. Fracturing fluid ("frac fluid"), often containing water, proppants and other additives, is pumped downhole by the frac pump, transmitting the pressure at the surface to an adequate pressure in the formation to cause the fractures and fissures to form.

As the frac fluid is abrasive and often corrosive, maintenance of frac pumps must occur regularly. Also, because of the great stress on the frac pumps, breakdowns can occur, hence the need for prognostic measures. Conventional methods to monitor frac pumps for an impending failure include manual monitoring, periodic inspections based on operator experiences, maintaining inventory of redundant parts and components are in practice to counter failures. However, these measures are not very effective or cost-efficient causing frequent downtimes and subsequent losses in productivity.

Some advanced methods include use of sensors to collect operational data regarding health of the frac pump. For example, U.S. Publication US2015/0356521 relates to a system for oilfield equipment asset utilization improvement. The system includes a controller having an equipment confidence module that interprets a condition value corresponding to each of a number of oilfield equipment, a job requirement module that interprets a performance requirement for an oil field procedure, and an equipment planning module that selects a set of units from the number of units of oilfield equipment in response to the performance requirement for the oilfield procedure and the condition value corresponding to each of the units of oilfield equipment. The system collects data for determining condition values through various sensors such as accelerometers. However, for obtaining accurate data from the sensors, placement of sensors in such systems is of prime importance.

Thus, an improved system for monitoring a frac pump is required.

SUMMARY OF THE DISCLOSURE

In an aspect of the present disclosure, a monitoring system for a fluid pump having a fluid end and a power end is provided. The monitoring system includes an inlet pressure sensor attached to an inlet manifold of the fluid end. The inlet pressure sensor generates a signal indicative of an inlet pressure of a fluid being supplied to the fluid end. The monitoring system includes a discharge pressure sensor attached to the fluid end. The discharge pressure sensor generates a signal indicative of a discharge pressure of the fluid exiting the fluid end. The monitoring system includes an accelerometer placed on a horizontal axis of the inlet manifold. The accelerometer generates a signal indicative of vibrational data of the fluid pump. The monitoring system further includes a controller communicably coupled to the inlet pressure sensor, the discharge pressure sensor and the accelerometer. The controller receives the signal indicative of the inlet pressure of the fluid from the inlet pressure sensor. The controller receives the signal indicative of the discharge pressure of the fluid from the discharge pressure sensor. The controller receives the signal indicative of the vibrational data from the accelerometer. The controller determines a possible failure mode of the fluid pump based on the signals received from the inlet pressure sensor, the discharge pressure sensor and the accelerometer.

DETAILED DESCRIPTION

Figure 1:
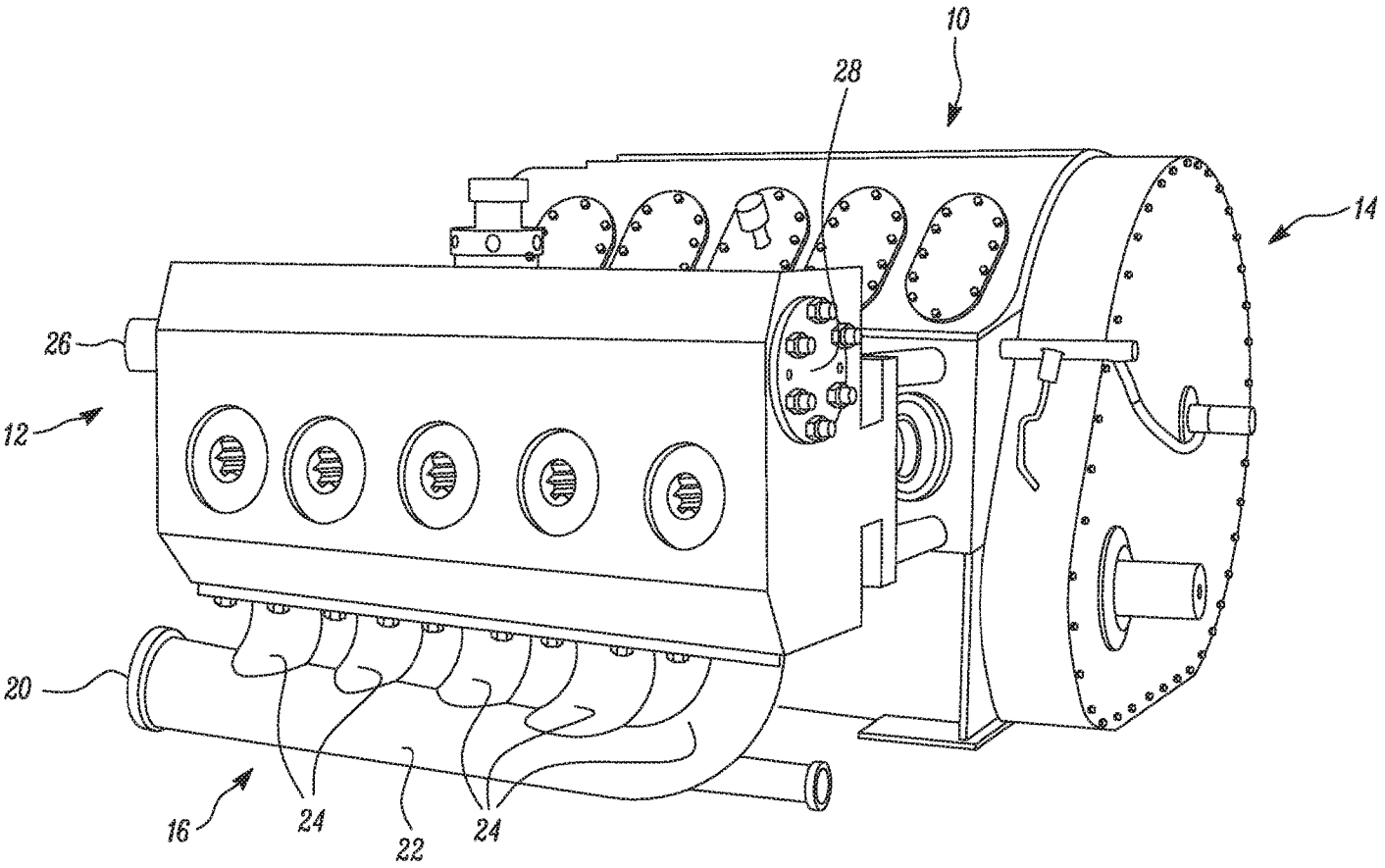
FIG. 1 shows a perspective view of a fluid pump, in accordance with an aspect of the present disclosure.

Wherever possible, the same reference numbers will be used throughout the drawings to refer to same or like parts. FIG. 1 illustrates a fluid pump 10. In the illustrated embodiment, the fluid pump 10 is a fracturing pump. The fluid pump 10 may be used to pressurize fluid to be supplied underground in order to induce cracks in earth so that hydrocarbons can flow through the cracks to the surface. However, the fluid pump 10 may also be used in any other suitable application as well without limiting the scope of the present disclosure. The fluid pump 10 has a fluid end 12 and a power end 14.

The fluid end 12 includes an inlet manifold 16 for receiving the fluid at an inlet pressure and a discharge port 26 for discharging the fluid at a discharge pressure. In the illustrated embodiment, the inlet manifold 16 is illustrated as having an inlet port 20 leading to a common rail 22. Multiple inlet lines 24 supply fluid from the common rail 22 to respective pumping chambers (not shown). A suction valve (not shown) may be provided to regulate the flow of the fluid from the common rail 22 to the pumping chambers. The fluid is pressurized in the pumping chambers and discharged through the discharge port 26 at the discharge pressure to the required location. A discharge valve (not shown) may be provided to regulate the flow of fluid from the pumping chamber to the discharge port 26. The discharge pressure is higher than the inlet pressure. Although only one discharge port 26 is shown in operational state, an additional discharge port 28 is also provided. The additional discharge 28 port may be operational as per the requirements of the current application.

The power end 14 converts in inputted rotational movement into linear movement to actuate components and parts of the fluid end 12 to pressurize the fluid from the inlet pressure to the discharge pressure. Multiple sensors are installed on the fluid pump 10 for monitoring various operational parameters of the fluid pump 10.

Figure 2:
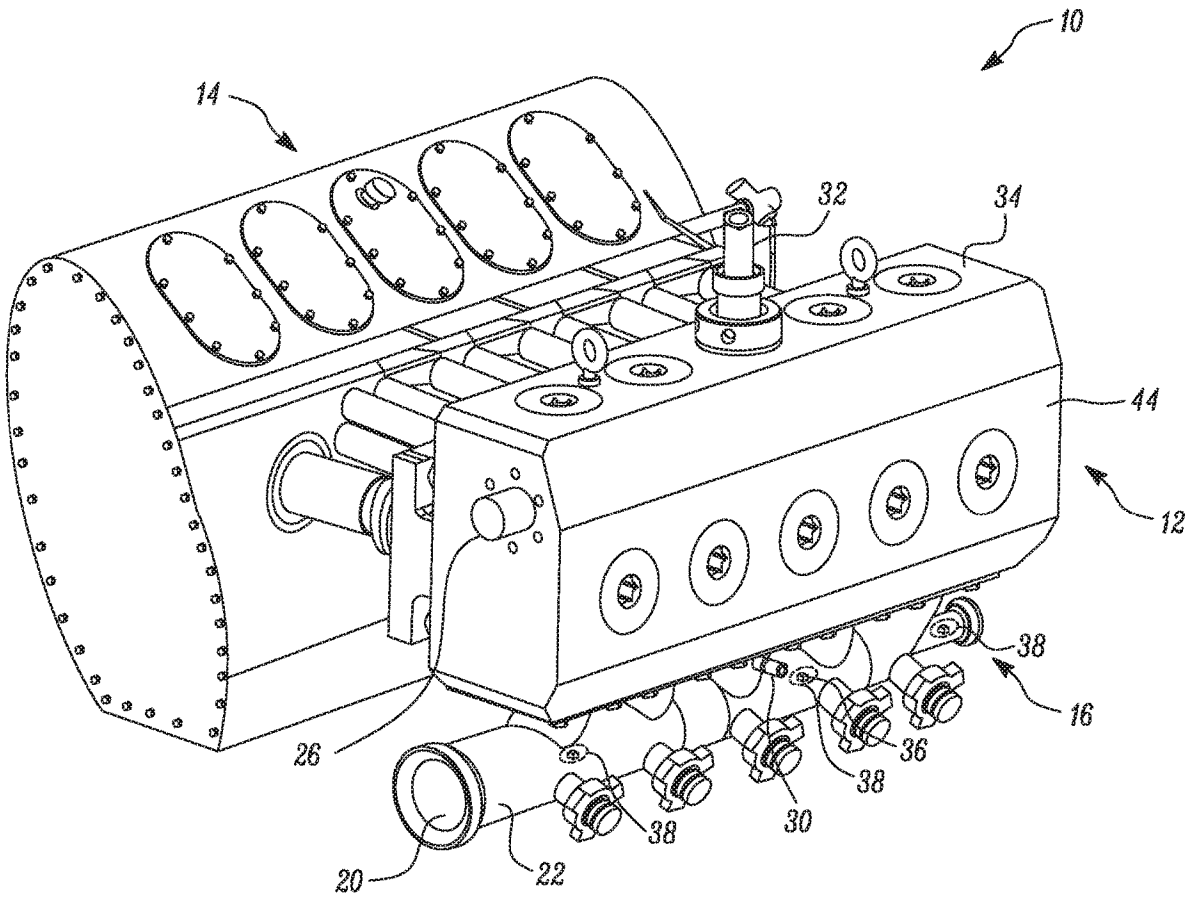
FIG. 2 shows a perspective view of the fluid pump illustrating possible positions of accelerometer, in accordance with an aspect of the present disclosure.

FIG. 2 illustrates positions of various sensors installed on the fluid pump 10. An inlet pressure sensor 30 is attached to the inlet manifold 16 to measure the pressure of the fluid entering the fluid pump 10 through the inlet manifold 16. The inlet pressure sensor 30 may be attached at any suitable position on the inlet manifold 16. In the illustrated embodiment, the inlet pressure sensor 30 is installed on the common rail 22 of the inlet manifold 16. The inlet pressure sensor 30 may be any type of a conventional pressure sensor which may measure pressure of the fluid entering the inlet manifold 16. The inlet pressure sensor 30 generates a signal indicative of the inlet pressure.

A discharge pressure sensor 32 is attached through atop surface 34 of the fluid end 12 to a hole connected to the discharge port 26 to measure the pressure of fluid exiting the fluid end 12 of the fluid pump 10 through the discharge port 26. The discharge pressure sensor 32 may be any type of a conventional pressure sensor which may measure pressure of the fluid exiting the fluid end 12. The discharge pressure sensor 32 generates a signal indicative of the discharge pressure. Further, an accelerometer 36 is attached to the fluid end 12.

The accelerometer 36 may be placed at any location on the fluid end 12. In one embodiment, the accelerometer 36 is placed at one of three positions 38 on the inlet manifold 16 as depicted in the FIG. 2. The accelerometer 36 may also be placed on any other location on the inlet manifold 16. In another embodiment, the accelerometer 36 may be placed on a front surface 44 of the fluid end 12. The accelerometer 36 may be a single axis accelerometer or a multi-axis accelerometer. In an embodiment, the accelerometer 36 may be a tri-axial accelerometer having sensitivity along a single axis according to the need of the present disclosure. In another embodiment, more than one accelerometer 36 may be used. Number of the accelerometer 36 being used may vary as per the need of the current application. The accelerometer 36 collects vibrational data related to the fluid pump 10 and generates a signal indicative of the vibrational data of the fluid pump 10.

Figure 3:
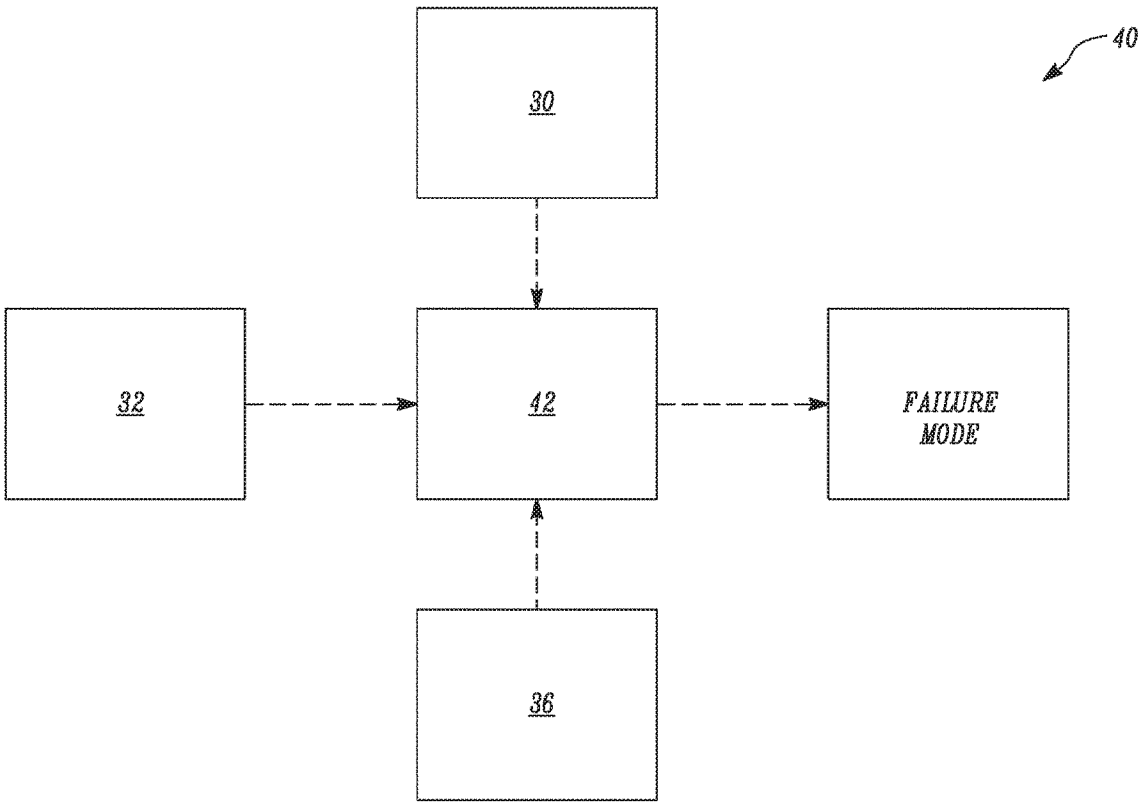
FIG. 3 shows a block diagram of a monitoring system for the fluid pump, in accordance with an aspect of the present disclosure.

The vibrational data is indicative of operational status of the fluid pump 10. Vibrational data may indicate an impending failure of the fluid pump 10 if the vibrational data provided by the accelerometer 36 is outside acceptable ranges defined for proper functioning of the fluid pump 10. Various failure modes may be identified based on the vibrational data collected by the accelerometer 36. A monitoring system 40 for determining a possible failure of the fluid pump 10 is described with the help of FIG. 3.

The monitoring system 40 includes a controller 42. The controller 42 may be attached to the fluid pump 10 at a suitable location on the power end 14. In an embodiment, the controller 42 may be located at an off-board location relative to the fluid pump 10. The controller 42 may be an Electronic Control Module (ECM), a microprocessor, or any other type of device which is capable of reading and or analyzing the information from the sensors and providing output. The controller 42 may be a single controller or a combination of multiple controllers.

A telematics unit (not shown) may also be communicably coupled with the controller 42. The telematics unit may be placed on the fluid pump 10 with the controller 42. In another embodiment, the telematics unit may also be placed at an off-board location relative to the fluid pump 10. The telematics unit may be an integral part of the controller 42 instead of a separate unit and the data may be stored by the controller 42 or the telematics unit in an associated memory.

The monitoring system includes the inlet pressure sensor 30, the discharge pressure sensor 32 and the accelerometer 36. The controller 42 is communicably coupled to the inlet pressure sensor 30, the discharge pressure sensor 32 and the accelerometer 36. The controller 42 receives the signal generated by the inlet pressure sensor 30 indicative of the inlet pressure of the fluid entering the inlet manifold 16 of the fluid pump 10. The controller 42 also receives the signal generated by the discharge pressure sensor 32 indicative of the discharge pressure of the fluid exiting the fluid end 12 of the fluid pump 10. Further, the controller 42 receives the signals generated by the accelerometer 36 indicative of the vibrational data related to the operational characteristics of the fluid pump 10.

The controller 42 processes the signals received from the inlet pressure sensor 30, the discharge pressure sensor 32 and the accelerometer 36 to determine whether any of the operational parameters of the fluid pump 10 are outside the acceptable ranges. The controller 42 may have the acceptable ranges of the various operational parameters stored in the associated memory. In one embodiment, the controller 42 may collect data from the various sensors and transmit the data to the off-board location. The off-board location may have data models corresponding to various types of failure modes of the fluid pump 10 based on historical data collected. Examples of failure modes can be a suction valve leak, a discharge valve leak, a packing seal leak etc. Any conventional methods may be used to generate the failure data models such as an artificial neural network etc.

The data transmitted by the controller 42 is compared with various failure models. Based on the comparison, it is determined whether the fluid pump 10 is operating under a possibility of an impending failure. After determining if the fluid pump 10 may have a failure according to current operational data, the controller 42 may issue a warning to concerned personnel about the same. Appropriate action may be taken to avoid downtime due to failure of the fluid pump 10. According to the failure mode, corresponding components may be replaced or subjected to a maintenance procedure. The controller 42 may also suggest change in operational parameters to avoid the failure mode. Any suitable strategy may be used according to the need of the present application.

INDUSTRIAL APPLICABILITY

The monitoring system 40 for the fluid pump 10 described in the present disclosure includes the inlet pressure sensor 30 attached to the inlet manifold 16, the discharge pressure sensor 32 attached to the fluid end 12 and the accelerometer 36 attached to the fluid end 12. The controller 42 receives signals from the sensors indicative of various operational parameters of the fluid pump 10 and determines a possible failure mode of the fluid pump 10 by comparing the data collected by the sensors with historical data models of the failure modes.

As the controller 42 determines whether the fluid pump 10 is going to fail, appropriate measures can be taken to avoid/reduce downtime of the fluid pump 10. The fluid pump 10 may be scheduled to a maintenance procedure or may be replaced with another fluid pump. Any other such measure may also be taken so that the fluid pump 10 does not fail while the fluid pump 10 is operational. Substantial costs may be saved by taking measures beforehand as the failure of the fluid pump 10 can be predicted in a better and more accurate manner.

Further, the monitoring system 40 also provides information about type of the failure mode. This may also provide an option to perform targeted maintenance/service procedure for the particular component which may fail. Thus, savings in terms of costs as well as time may be done as the maintenance/service procedure will be targeted to a particular component as compared to servicing all the components of the fluid pump 10. By focusing on the effected component, efficient maintenance can be performed and downtime can be reduced to a greater extent.

Thus, the monitoring system 40 provides an efficient prognostics system for the fluid pump 10. By having a reliable prognostics system in place, maintenance of inventory of replacement parts may also be managed in a better and efficient manner. This will bring down carrying cost of the inventory of the replacement parts leading to a lesser number of components to be maintained at a point of time.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A monitoring system for a fluid pump, the fluid pump having a fluid end and a power end, the monitoring system comprising:

an inlet pressure sensor attached to an inlet manifold of the fluid end, the inlet pressure sensor configured to generate a signal indicative of an inlet pressure of a fluid being supplied to the fluid end;

a discharge pressure sensor attached to the fluid end, the discharge pressure sensor configured to generate a signal indicative of a discharge pressure of the fluid exiting the fluid end;

at least an accelerometer attached to the fluid end, the at least one accelerometer configured to generate a signal indicative of vibrational data of the fluid pump; and a controller communicably coupled to the inlet pressure sensor, the discharge pressure sensor and the accelerometer, wherein the controller is configured to:

receive the signal indicative of the inlet pressure of the fluid from the inlet pressure sensor;

receive the signal indicative of the discharge pressure of the fluid from the discharge pressure sensor;

receive the signal indicative of the vibrational data from the accelerometer; and determine a possible failure mode of the fluid pump based on the signals received from the inlet pressure sensor, the discharge pressure sensor and the accelerometer.

2. The monitoring system of claim 1, wherein the determination of the possible failure mode is based on a comparison of the signals received from the inlet pressure sensor, the discharge pressure sensor and the accelerometer with pre-determined data models.

3. The monitoring system of claim 1, wherein the at least one accelerometer is attached to the inlet manifold.

4. The monitoring system of claim 1, wherein the at least one accelerometer is attached to a front surface of the fluid end.

5. The monitoring system of claim 1, wherein the controller is attached to the power end of the fluid pump.

6. The monitoring system of claim 1, wherein the controller is located at an off-board location to the fluid pump.

7. The monitoring system of claim 1, wherein the accelerometer is a single axis accelerometer.

8. The monitoring system of claim 1 wherein the accelerometer is a multi-axis accelerometer.

* * * * *